US006314731B1

(12) United States Patent
Tigane

(10) Patent No.: US 6,314,731 B1
(45) Date of Patent: Nov. 13, 2001

(54) THERMAL MACHINE

(76) Inventor: Rein Tigane, Kivivuorenkuja 2 1 81, Vantaa (FI), 01620

( * ) Notice: Subject to any disclaimer, the term of this patent is extended or adjusted under 35 U.S.C. 154(b) by 0 days.

(21) Appl. No.: 09/424,597

(22) PCT Filed: May 29, 1998

(86) PCT No.: PCT/FI98/00456

§ 371 Date: Mar. 6, 2000

§ 102(e) Date: Mar. 6, 2000

(87) PCT Pub. No.: WO98/54458

PCT Pub. Date: Dec. 3, 1998

(30) Foreign Application Priority Data

May 30, 1997 (FI) ..... 972321

(51) Int. Cl.[7] ..... F01B 29/10
(52) U.S. Cl. ..... 60/517; 60/520
(58) Field of Search ..... 60/508, 517, 519, 60/520

(56) References Cited

U.S. PATENT DOCUMENTS

| | | | | |
|---|---|---|---|---|
| 3,600,886 | | 8/1971 | Jaspers et al. | 60/24 |
| 4,327,550 | | 5/1982 | Knö ös | 60/522 |
| 4,428,197 | | 1/1984 | Liljequist | 60/525 |
| 4,711,091 | * | 12/1987 | Kawajiri et al. | 60/517 |
| 4,738,106 | * | 4/1988 | Yamaguchi | 60/517 X |
| 5,088,284 | * | 2/1992 | Momose | 60/517 |
| 5,195,320 | * | 3/1993 | Kushnir | 60/517 |

FOREIGN PATENT DOCUMENTS

| | | |
|---|---|---|
| 2439213 | 3/1976 | (DE) . |
| 52620 | 10/1977 | (FI) . |
| 467837B | 9/1992 | (SE) . |
| 9115672 | 10/1991 | (WO) . |

* cited by examiner

*Primary Examiner*—Hoang Nguyen
(74) *Attorney, Agent, or Firm*—Volpe & Koenig, P.C.

(57) ABSTRACT

Thermal machines are known in prior art. They generally differ considerably from the theoretically most advantageous engine in respect of pressure-volume cycles or have a complicated structure. The object of the present invention is to eliminate these drawbacks and achieve a new type of thermal machine. The advantages of the invention include a nearly ideal phasing of pressure-volume cycles, built-in power regulation and insignificant mechanical losses. This is achieved by using inversely linked connecting rods (9), four-chamber cylinders and a crankshaft (7) provided with rolling contact bearings with insertable rolling elements.

7 Claims, 1 Drawing Sheet

THERMAL MACHINE

The present invention relates to a thermal machine as defined in the preamble of claim 1.

A thermal machine functioning in accordance with the closed Camot cycle process can be used as an engine or as a refrigerating machine depending on whether the machine is started using thermal energy or mechanical energy. The working gas is contained in a closed system in the machine.

To produce useful thermodynamic processes, the gas undergoes in the various chambers in the machine the phases of compression, transfer, expansion and restoration to the original state. The efficiency of the machine depends on its phasing precision. To implement the phase shift between the pistons, e.g. a rhombic crank mechanism functioning with two crankshafts and a lever mechanism has been developed.

Prior art engines have the drawback that, in respect of pressure-volume cycles, they differ considerably from the theoretically most advantageous values or that they are complicated. Moreover, in engines provided with a complicated rhombic crank mechanism, the cyclic phasing is inaccurate.

The object of the present invention is to achieve a new type of thermal machine that is free of the drawbacks described above. To implement this, the thermal machine of the invention is characterised by what is presented in the characterisation part of claim 1.

The advantages of the invention can be regarded as consisting in the nearly ideal phasing of pressure-volume cycles, small mechanical losses and relatively simple structure. With the solution of the invention, and accurate phasing of the cycle process is achieved by using a "stretched" top dead position of the pistons. In addition, the built-in power regulating circuit of the invention is simple to implement.

Figure 1:
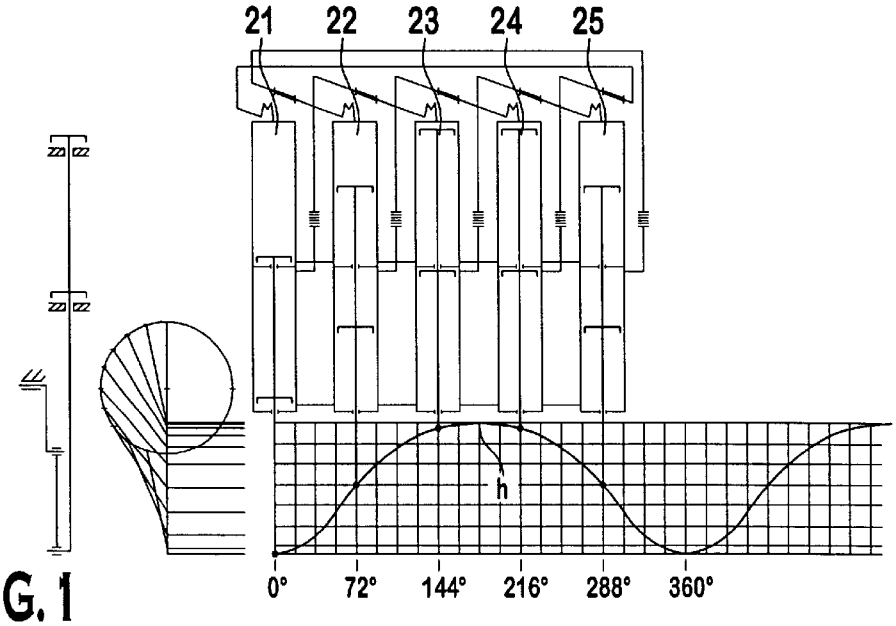
Figure 2:
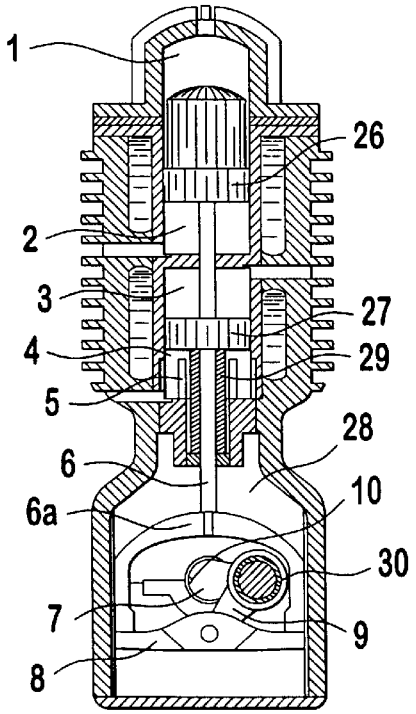
Figure 3:
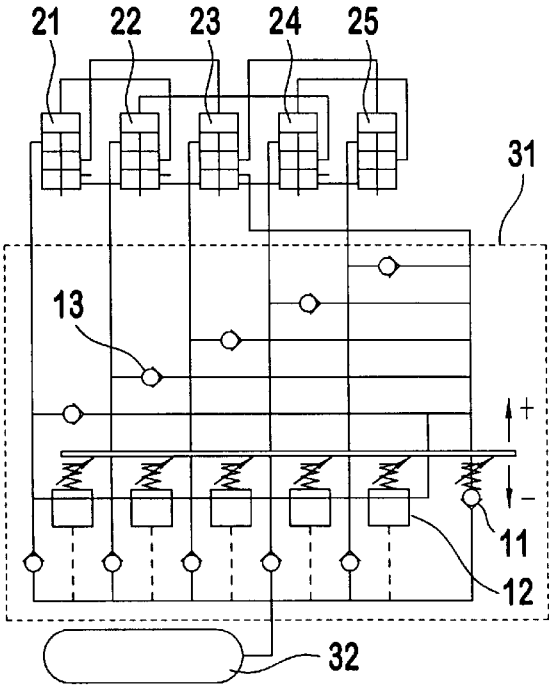

In the following, the invention will be described in detail by the aid of an example by referring to the attached drawings, wherein FIG. 1 is a graph illustrating the operation of the thermal machine of the invention, FIG. 2 presents the structure of the thermal machine of the invention, sectioned along a plane passing through a piston, and FIG. 3 presents a schematic diagram of the power regulation system used with the thermal machine of the invention.

The thermal machine presented in the figures is a five-cylinder (cylinders 21–25 in FIG. 1) Stirling engine.

The cross-section in FIG. 2 shows a cylinder with four chambers: hot chamber 1, compression chamber 3 and pressure equalisation chambers 2 and 4, which are interconnected (FIGS. 1 and 3). The compression chambers 3 are connected to the hot chambers 1 with a 144° delay (FIG. 1). The pistons 26, 27 are attached to the same piston rod 6. The piston rod 6 is provided with a sealing 29 between pressure equalisation chamber 4 and the crankcase 28, and the connecting rod 9 is linked to the piston rod 6 in an inverted manner, i.e. not in the direction of the pistons, via a fork 6*a* and a bracket 8.

The inversely linked short connecting rod 9 enables accurate phasing of the cycle process because of the "stretched" top dead centre the volume of the hot chamber 1 and compression chamber 3 is smallest at the gentle crest h of the piston motion curves in FIG. 1. When the pistons in the first cylinder 21 are in the low position, the pistons in the third cylinder 23 are in the top position (FIG. 1). When the crankshaft rotates through 72°, the volume of the compression chamber 3 is doubly reduced whereas the volume of the hot chamber 1 remains the same (isothermal phase, cylinders 22, 24). In the next 72° interval, the compressed gas is passed from the compression chamber into the hot chamber at the same volume (isochoric phase, cylinders 23, 25). In the next 72° interval, the gas expands isothermally in the hot chamber; the volume of the compression chamber does not change (cylinders 24, 21). In the last 144° interval, the gas is passed from the hot chamber into the compression chamber at the same volume (isochoric cooling, cylinders 25, 22, 21, 23). The compression ratio in the compression chambers 3 depends on the number of cylinders and relative length of the connecting rods. Instead of a fork 6*a* and bracket 8, it is possible to use a twin-crankshaft structure with two connecting rods and a T-joint to the piston rod.

The schematic diagram (FIG. 3) illustrating the power regulation system of the Stirling engine shows a power regulation unit 31 used for power regulation. It interconnects chambers 2 and 4 of each cylinder, and it is also connected to a pressure reservoir 32. In addition, the chambers of the cylinders are connected to each other as shown in FIG. 3.

In the power regulation unit 31, chamber 2 of each cylinder is connected via valves 13 to chambers 4 so that the gas will flow through the valves from chamber 4 into chamber 2. Chambers 4 are connected via a spring-loaded regulator valve 11 to the pressure reservoir 32 and via pressure-controlled variable check valves 12 to chambers 2. Valves 13 act as pump valves.

The output power is controlled by increasing and decreasing the amount of gas circulating in the engine, as follows:

The total volume of chambers 2, 4, which are interconnected via the power regulation unit 31, remains practically unchanged. At maximum power, chambers 2 and 4 as well as the pressure reservoir 32, are at equal pressure. To reduce the power, the spring pressure of the check valves 12 is reduced and free flow between chambers 2 is prevented while at the same time chambers 2 are forced to act as pumps. The working gas is passed from chambers 2 and 4 into the pressure reservoir 32. The pressure in the compression chambers is equalised with the pressure in chambers 2 and 4 when the pistons are in the low position as chambers 3 and 4 are interconnected via channels 5. At the same time, the channels 5 eliminate the negative effects of gas leaks.

When the reservoir pressure and the control pressure exceed the spring pressure of valve 12, valves 12 are opened and the engine will work at the selected power level. The power is increased via valve 11. By reducing the spring pressure of the valve, gas at positive pressure will flow from the reservoir 32 into the engine and be distributed in the same way as when the power is being reduced. When the spring pressure exceeds the overpressure in the reservoir, valve 11 will be closed.

To reduce mechanical losses and to avoid starting damage, the crankshaft 7 is provided with rolling bearings 30 with insertable roller elements. The outer rings of the main bearings as well as the connecting rods are slid onto the crankshaft, whereupon the roller elements are inserted via grooves 10. The sealing 29 on the piston rod is an accordion-type spiral, one half of which is dextrorse and the other sinistrorse. The spring-like structure also reduces the static imbalance due to the projecting piston rod.

What is claimed is:

1. Thermal machine which operates in accordance with a closed cycle process principle, comprising a cylinder with a hot chamber separated from a first pressure equilisation chamber by a first piston, and a compression chamber separated from a second pressure equilisation chamber by a second piston, the first and second pistons being attached to a piston rod, a connecting rod linked between a crankshaft and the piston rod in an inverted manner so that a volume of the hot chamber and the compression chamber is smallest at a gentle crest formed in a motion curve of the pistons.

2. Thermal machine of claim 1, wherein the pressure equilisation chambers below the pistons are pressurized and have a pressure equal to a pressure in the compression chamber when the pistons are in a low position.

3. Thermal machine of claim 1, wherein the pressure equilisation chambers below the pistons act as a power regulating compressor and as a pressurizing chamber in conjunction with the compression chamber.

4. Thermal machine of claim 1, wherein the crankshaft is fitted with insertable rolling elements.

5. Thermal machine of claim 1, wherein there are a plurality of cylinders, and machine power is controlled by a power regulating unit with a connected pressure reservoir, the power regulating unit comprises a pressure-controller check valve for each of the cylinders, the check valves being controlled in synchronism with a regulator valve by the aid of pump valves.

6. Thermal machine of claim 1, further comprising at least one of channels located in the equalisation chambers or holes located in the piston rods for pressure equilisation.

7. Thermal machine of claim 1, further comprising a seal between the cylinder and a crankcase of the thermal machine, the seal is an accordion-type spiral having a first half made of dextrose and a second half made of sinistrorse.

* * * * *

UNITED STATES PATENT AND TRADEMARK OFFICE

CERTIFICATE OF CORRECTION

PATENT NO. : 6,314,731 B2
DATED : November 13, 2001
INVENTOR(S) : Rein Tigane

It is certified that error appears in the above-identified patent and that said Letters Patent is hereby corrected as shown below:

Column 4,
Line 14, delete "dextrore" and insert therefor -- dextrorse --.

Signed and Sealed this

Fourth Day of June, 2002

*Attest:*

*Attesting Officer*

JAMES E. ROGAN
*Director of the United States Patent and Trademark Office*